US011161577B1

(12) United States Patent
Houston

(10) Patent No.: US 11,161,577 B1
(45) Date of Patent: Nov. 2, 2021

(54) PERSONAL FLOTATION DEVICE WITH SAFETY FEATURES

(71) Applicant: Poliana Houston, Lake Charles, LA (US)

(72) Inventor: Poliana Houston, Lake Charles, LA (US)

( * ) Notice: Subject to any disclaimer, the term of this patent is extended or adjusted under 35 U.S.C. 154(b) by 0 days.

(21) Appl. No.: 17/332,599

(22) Filed: May 27, 2021

Related U.S. Application Data

(60) Provisional application No. 63/031,521, filed on May 28, 2020.

(51) Int. Cl.

| | |
|---|---|
| ***B63C 9/04*** | (2006.01) |
| ***B63C 9/23*** | (2006.01) |
| ***B63B 45/00*** | (2006.01) |
| *B63C 9/01* | (2006.01) |

(52) U.S. Cl.
CPC ..... *B63C 9/04* (2013.01); *B63C 9/21* (2013.01); *B63C 9/23* (2013.01); *B63B 2201/12* (2013.01); *B63C 9/01* (2013.01); *B63C 2009/042* (2013.01)

(58) Field of Classification Search
CPC .... B63C 9/00; B63C 9/01; B63C 9/04; B63C 9/21; B63C 9/23; B63C 2009/042; B63C 9/08; B63C 9/125; B63C 9/22
USPC ..... 441/40, 41, 42, 129
See application file for complete search history.

(56) References Cited

U.S. PATENT DOCUMENTS 4,362,517 A * 12/1982 Martin ..... B63C 9/04 441/41
4,579,536 A 4/1986 Cameron
6,080,027 A * 6/2000 Rodemann ..... B63B 43/12 441/41

(Continued)

FOREIGN PATENT DOCUMENTS

CA 2090002 A1 2/1992
CN 109911145 A 6/2019

(Continued)

OTHER PUBLICATIONS

"Regular Hexagon Marine Life Saving Equipment 6 Person Throw Over Board Life Raft", Deyuan Marine, http://www.windlasswinch.com/sale-6841209-regular-hexagon-marine-life-saving-equipment-6-person-throw-over-board-life-raft.html [Date accessed: Mar. 11, 2020].

*Primary Examiner* — Lars A Olson
(74) *Attorney, Agent, or Firm* — Binita J. Singh; Bold IP, PLLC

(57) ABSTRACT

A personal safety flotation device which can be carried on a person for an evacuation requiring entry into a body of water. The personal safety flotation device is for individual use comprising a carrying bag and an inflatable platform which is stowed in the carrying bag in a deflated state. The inflatable platform has a hexagonal shape allowing stability on the water and ability to connect to other inflatable platforms to create a larger surface area. The inflatable platform comprises additional safety features such as an emergency radio beacon, LED lights, light reflective strip, radar reflective pad, rope around a perimeter, and spring hooks for attachment. The carrying bag is attachable to a person and upon entry into a body of water the inflatable platform is automatically inflated with a connected com- (Continued)

pressed gas cylinder and the inflatable platform remains connected to the carrying bag via a connection strap.

20 Claims, 7 Drawing Sheets

(56) References Cited

U.S. PATENT DOCUMENTS 7,056,179 B2 * 6/2006 Courtney ..... B63C 9/04
441/90

FOREIGN PATENT DOCUMENTS

GB 2136737 A 9/1984
KR 20160095283 A 8/2016

* cited by examiner

PERSONAL FLOTATION DEVICE WITH SAFETY FEATURES

CROSS REFERENCE TO RELATED APPLICATION

This application claims benefit of U.S. Provisional Application No. 63/031,521 filed on May 28, 2020, which is incorporated by reference in its entirety.

TECHNICAL FIELD

The overall field of this invention relates to survival devices in marine environments, in particular to an inflatable flotation device with safety features to survive in a marine disaster and aid in search and rescue.

BACKGROUND

Sea travel, for leisure or commercial purposes, is an important part of marine economics. Personal safety on board a vessel is of utmost priority on the ship, especially in case of a mishap while on sea. International laws and regulations require many safety measures on a vessel. In addition to all of a ship's safety systems, lifesaving apparatuses such as life rafts or lifeboats and personal protection equipment such as life jackets are vital pieces of safety equipment. Cruise ships and shipping companies must contain life jackets for all the passengers and crew onboard their vessels. These are usually located within the cabins and additional jackets may be located by the lifeboat or on the lifeboat itself. However, this requires that during a seafaring accident, each person is required to make their way either to their cabin or another location to get a life jacket. During an emergency where people can feel vulnerable and threatened, searching for safety equipment can lead to confusion and panic.

There are also lifeboats and/or self-inflatable life rafts which are carried by sea vessels in case of a disaster which requires passengers and crew to evacuate the ship. However, in a situation like this, the passengers or crew who do not know how to deploy the lifeboats or the life rafts have to wait for crew that have been trained in case of such an emergency. These individuals are therefore left reliant and in a panicked position while they wait for the crew member to deploy these apparatuses. Another example of where lifeboats may be lacking is when a lifeboat cannot be deployed because the ship is listed to a side where deployment is not possible. This can lead to unexpected danger because the safety device cannot be used.

Sea travel is unpredictable, and a number of scenarios can cause a person to fall overboard. For example, an elevated sea state can slam a person against a bulkhead or a railing before falling overboard, or sometimes even a forceful impact of falling into the sea can render a person unconscious. In such a situation, a person is not able to deploy any safety device.

Hence, there exists a need for a personal safety flotation device which is easily accessible for all sea faring individuals and is readily accessible and deployable in an emergency situation necessitating rescue and/or evacuation.

SUMMARY

The present disclosure recognizes the unsolved need for an improved and individualized safety device for use during an emergency at sea by providing for a personal safety flotation device which is integrated with safety features to make evacuation and rescue at sea safer and quicker.

In a preferred embodiment, the personal safety flotation device includes an inflatable platform and a carrying bag within which the inflatable platform is stored in an uninflated state. The carrying bag with the inflatable platform can be carried on a person at all times while at sea or can be quickly put on during an emergency at sea. The inflatable platform is connected to the carrying bag through a connection cord such that the inflatable platform stays near a person so there are no chances of the inflatable platform drifting away from the person upon inflation or any other time thereafter.

Preferably, the personal safety flotation device also comprises a LED light system, an emergency thermal blanket, a GPS receiver, one or more spring hooks, a self-inflating gas cylinder connected to a valve, a manual valve, a whistle, a radar reflector pad, and one or more light reflective pads.

The presently disclosed personal safety flotation device is further described in the attached drawings and detailed description below.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
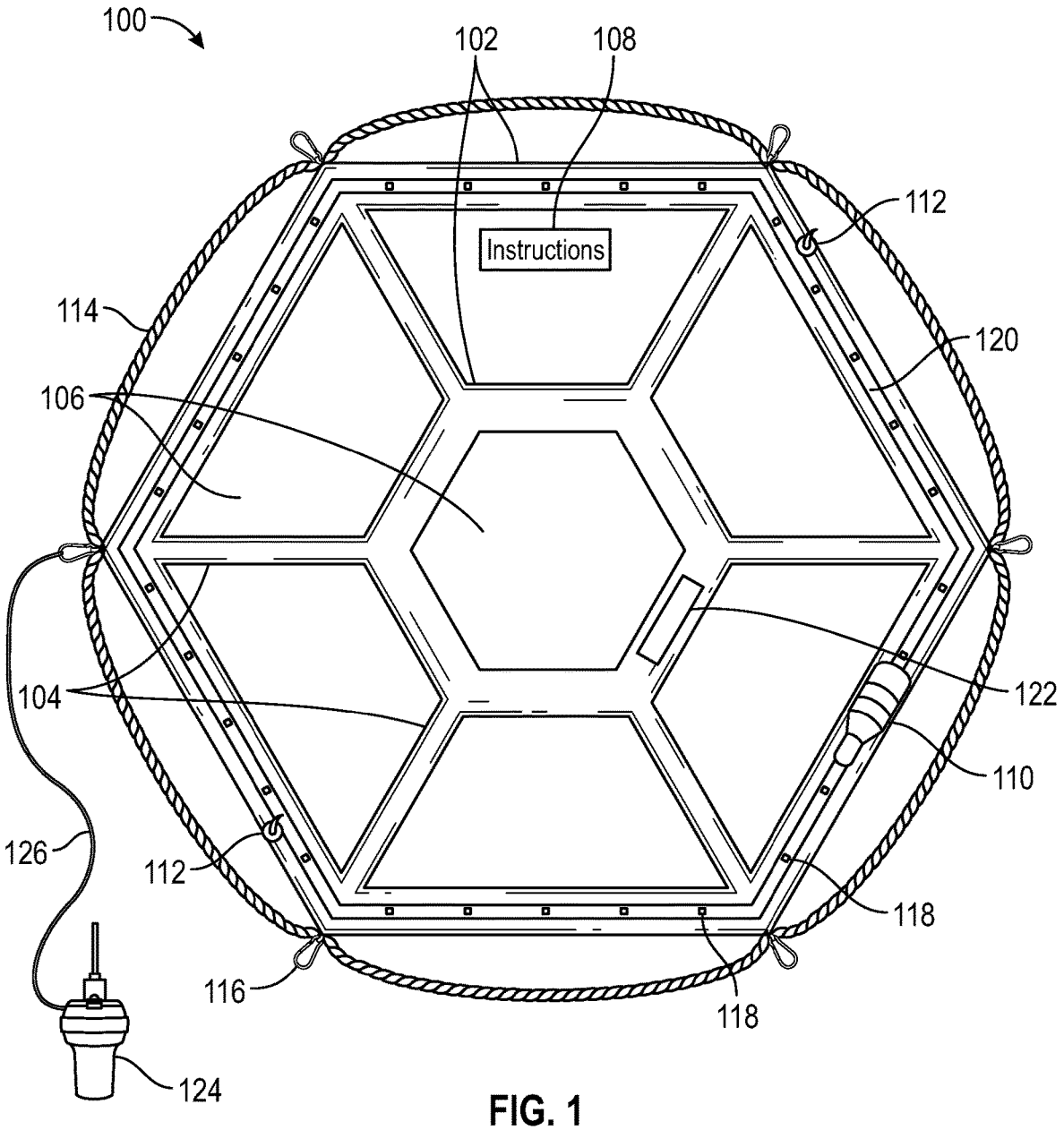
FIG. 1 is an illustration of an exemplary inflatable platform of a personal flotation safety device.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature may also be used, to the extent possible, in combination with and/or in the context of other particular aspects and embodiments of the invention, and in the invention generally.

Where reference is made herein to a method comprising two or more defined steps, the defined steps may be carried out in any order or simultaneously (except where the context excludes that possibility), and the method may include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items" may indicate the presence of only one item or may indicate more items. Thus, the term "set" may be equivalent to "one or more" as used herein.

The present disclosure recognizes the unsolved need for an improved and individualized safety flotation device for use during a sea emergency. The presently disclosed personal flotation safety device comprises of an inflatable platform and a carrying bag which can be carried on a person while at sea or is readily available to be carried on a person in the event of an emergency on board a water vessel requiring evacuation and/or rescue at sea. The inflatable platform is configured to be stored in the carrying bag in an uninflated state. The carrying bag can be carried on a person and is thus adapted to attach to a person by including, and not limited to, straps with a clipping mechanism to wrap and secure around a person's waist.

The inflatable platform is configured to have a geometric shape. The inflatable platform comprises of a plurality of inflatable tubes concentrically arranged and spaced apart from each other, wherein each of the plurality of inflatable tubes is configured in a hexagonal shape. Thus, each of the plurality of inflatable tubes has six vertices wherein each vertex is formed where two sides of an inflatable tube meet. The inflatable platform also comprises of a plurality of inflatable bars wherein each of the plurality of inflatable bars is configured between and connects adjacent inflatable tubes at their vertices with air used to inflate communicating between the plurality of inflatable tubes and the plurality of inflatable bars. Together, the inflatable tubes and the inflatable bars give the inflatable platform a spider web-like appearance when viewed from a top. The plurality of inflatable tubes and the plurality of inflatable bars are configured as a tubular structure which are capable of being filled with air and comprise the inflatable part of the personal flotation safety device. A floor layer is integrated between the plurality of inflatable tubes and the plurality of inflatable bars. The floor layer comprises a flat surface that is not inflatable and adds structure between the inflatable plurality of inflatable tubes and the plurality of inflatable bars. Together the inflatable tubes, the inflatable bars, and the floor layer form the basis of a structure of the inflatable platform sufficient to support a person on a water's surface. The inflatable platform enables a person to remain safely out of the water and not having to tread water to attract any marine predators and also conserve energy.

In a non-limiting preferred embodiment, the plurality of inflatable tubes and the one or more inflatable bars are fashioned from a material that is thin, elastic, durable, and capable of retaining air when inflated such as, and not limited to, polyvinyl chloride (PVC), polyurethane coated nylon, and rubbers which may preferably be layered to create a strong layer.

The floor layer, as the name suggests provides a floor and structure to the inflatable platform. The floor layer also provides flexibility to the structure and a reliable system which keeps the flotation platform from tipping over in high waves and choppy water. The floor layer provides such a reliable system through bending and adapting the overall structure by conforming to the movement of the water around the inflatable platform. The floor layer for the inflatable platform may be fashioned from heavy-duty durable material such as, but not limited to, PVC, a textile, a mesh, a vinyl coated polyester mesh, and other durable material which is capable of supporting a person's weight and being able to conform to the movement of the water. In alternate embodiments, the area between the inflatable bars may be provided with a netting or mesh like floor which adds more flexibility to the inflatable platform to conform to the movement of the water.

The inflatable platform of the personal flotation safety device comprises of dual inflation means. Preferably, an outermost inflatable tube is equipped with a valve connected to a compressed $CO_2$ inflation cylinder which is stored under high pressure. The $CO_2$ inflation cylinder automatically inflates the inflatable platform through the valve when contacted with water. Additionally, the flotation platform also comprises one or more manual valves which would be used to manually inflate the flotation platform by the user blowing air through the manual valve either by mouth or a small handpump which is included in the carrying bag.

The inflatable platform also comprises of attachment means, wherein the attachment means allow one inflatable platform to connect to a second inflatable platform. In a preferred embodiment, the attachment means are integrated on the vertices of the outermost inflatable tube at a side that extends away from a center of the inflatable platform. The outermost inflatable tube has one or more fabric loops wherein at least one fabric loop is integrated on each vertex of the outermost inflatable tube. The attachment means preferably include spring hooks wherein the fabric loop at each of the vertices has at least one spring hook. Thus, one inflatable platform may connect to six inflatable platforms which is the number of sides the inflatable platform has due to the hexagonal geometric shape.

The inflatable platform also comprises of one or more ropes that are placed around the perimeter of the outermost inflatable tube. The one or more ropes having several advantages, including and not limited to that the one or more ropes can be used to cling to the inflatable platform when in the water, used to pull oneself onto the inflatable platform, and a rescue team can use during a rescue attempt. In one non-limiting embodiment, the one or more ropes may be a single rope placed through the fabric loops. In this embodiment, the single rope may have a length that is commensurate with the perimeter of the outermost inflatable tube in that the length of the rope is longer than the perimeter of the outermost inflatable tube. The single rope having a longer length ensures that that the rope is able to go all the way around the entire perimeter of the outermost inflatable tube and also has some room to give so that a person may hold on to the rope.

In an alternate non-limiting embodiment, the one or more ropes are attached at strategic locations around the perimeter of the outermost inflatable tube. The strategic location is preferably at the vertices of the outermost layer such that each of a side of the outermost inflatable tube has a rope directly attached at its vertices. In any of the embodiments, the one or more ropes are also advantageous in being used as lifting straps during a rescue. A helicopter may use its rescue device such as a hook to attach to the ropes on the inflatable platform for lifting a person nestled securely within.

The present disclosure of the personal flotation safety device also comprises additional features in consideration of increasing rescue efforts and survival at sea. The personal flotation safety device also comprises of a plurality of LED lights which are preferably integrated to the outermost inflatable tube. The plurality of LED lights is ideally provided on a strip, and referred to as a LED light strip, which is then integrated to the outermost inflatable tube such that when the inflatable platform expands upon inflation the plurality of lights is facing upward and easily visible to rescuers. The LED light strip is integrated over an entire perimeter of the outermost inflatable tube. It is also contemplated that the plurality of lights may additionally be integrated on one or more of the plurality of inflatable tubes and one or more of the plurality of inflatable bars to make the inflatable platform more noticeable.

The personal flotation safety device also comprises of a light reflective tape which is ideally integrated on the inflatable platform. In the non-limiting preferred embodiment, the light reflective tape may be integrated along the entire perimeter of the outermost inflatable tube. It is also contemplated that the light reflective tape may additionally be integrated onto one or more plurality of inflatable tube and one or more plurality of inflatable bars, again to make the inflatable platform more noticeable. In the non-limiting preferred embodiment, the light reflective tape may be integrated on the LED light strip in a manner such as not to cover the plurality of LED lights. Alternatively, the light reflective tape may be directly integrated onto the inflatable platform.

In addition, the personal flotation safety device also comprises of a radar reflector. Radar reflectors reflect radar energy from other vessels' radars which allows a user's boat to show as a larger and more consistent target on a radar screen. The radar reflector comprising part of the personal flotation safety device can be a radar reflective pad integrated onto one or more surfaces of the plurality of inflatable tubes Alternatively, the radar reflector can be a provided as a radar reflector tube which is integrated onto the inflatable platform. The radar reflector tube is provided with a mounting bracket wherein the mounting bracket is integrated onto one of inflatable tubes of the plurality of inflatable tubes. When the inflatable platform is inflated, the radar reflector tube is positioned vertically.

The personal flotation safety device also comprises an emergency radio beacon which is used to alert search and rescue services. The emergency beacon can comprise of a compact emergency position indicating radio beacon (EPIRB) or a personal locator beacon (PLB) wherein both devices are designed to operate with satellites. When the emergency beacon is activated, it starts to transmit a signal which is detected by satellites. In a non-limiting example, the EPRIB comprises the emergency radio beacon of the personal flotation safety device. The EPIRB is ideally attached to the inflatable platform via a cord, where a first end of the cord is connected to the EPIRB and a second end of the cord connects to the spring hook on one of the vertices on the outermost inflatable tube. The EPRIB can be manually activated and/or auto activate upon immersion in water. The emergency radio beacon can be provided in the carrying bag.

Advantageously, the inflatable platform is securely connected to the carrying bag such that upon inflation the inflatable platform remains attached to the carrying bag which is connected to a person carrying the carrying bag. The inflatable platform is secured to the carrying bag by a strap, referred to as a connection strap which may be a narrow strip of strong flexible material to securely hold them together. The connection strap is preferably 3 feet to 5 feet in length and has two ends. A first end is preferably sewn on an inside portion of the carrying bag on an inside seam. The first end may also be connected to a small loop wherein the small loop is sewn on the inside of the carrying bag. A second end is connected to the inflatable platform preferably to one of the spring hooks at the outermost inflatable tube. It is advantageous because the inflatable platform is released from within the bag when it inflates and thus does not separate and drift away from a user who has the carrying bag wrapped around the waist, and thus making it possible for the user to access the inflatable platform. In the case a strong wave pushes the person on the inflatable platform overboard, the connection cord connected to the inflatable platform again ensures that the person remains close and is able to access the inflatable platform.

The inflatable platform described above is normally stowed folded in the carrying bag which may be wrapped around a person's waist or be easily accessible to wrap around a person's waist at the appropriate time. Whenever an emergency arises wherein the personal flotation safety device is needed, such as the sinking of a watercraft, the inflatable platform can be deployed by jumping into the water and upon contact with the water, the automatic inflation mechanism of the $CO_2$ cartridge is activated. The automatic inflation with the $CO_2$ cartridge inflates the plurality of inflatable tube and the plurality of inflatable bars which then causes the inflatable platform to expand, push open the carrying bag, and continue inflating outside of the carrying bag and assume an inflated structure. Upon inflation, the inflatable platform remains connected to the carrying bag through the connection strap and to the person whereby a person may pull the inflatable platform toward oneself with the connection strap or swim toward the inflatable platform.

The personal flotation safety device also comprises of a set of instructions for the safe deployment, operation, and use of all equipment on the inflatable platform. The instructions can be integrated in a permanent manner on a section of the floor layer such that the instructions are durable to be water and wear resistant. Alternatively, the instructions can be integrated on a section of the inflatable tube. The instructions can alternatively or in addition also be provided on the carrying bag wherein the instructions are shielded from the water.

The personal flotation safety device also comprises of necessities such as and not limited to an emergency thermal wrap, food items, and a whistle. The items can be provided in the carrying bag wherein the carrying bag comprises a pocket on the inside portion. Alternatively, the necessities can also be provided on the inflatable platform wherein a pocket is also integrated on any portion of the floor layer.

In referring to the figures, FIG. 1 through FIG. 7 depict a non-limiting exemplary embodiment of a personal flotation safety device. FIG. 1 illustrates a non-limiting embodiment of an inflatable platform 100 and some additional features that comprise the personal flotation safety device. As mentioned above, the inflatable platform 100 is configured to have a geometric shape and comprises of a plurality of inflatable tubes 102 and a plurality of inflatable bars 104. In the non-limiting example depicted in FIG. 1, the inflatable platform 100 is shown to be comprised of two inflatable tubes 102 which are hexagonally shaped and concentrically arranged at a certain distance from each other. The inflatable bars 104 connect the concentric inflatable tubes 102. The inflatable tubes 102 and the inflatable bars 104 are tubular structures designed to be inflated. Further, as shown in FIG. 1, the inflatable platform 100 also comprises of a floor layer 106 which is configured to be connected to the inflatable tubes 102 and the inflatable bars 104 and is a flat surface which is not inflatable. Inflatable platform 100 may also be configured to include instructions 108 on how to use the inflatable platform 100 and other safety features comprising the personal flotation safety device.

As shown in the non-limiting embodiment in FIG. 1, additional safety features comprising and integrated on the inflatable platform 100 are a $CO_2$ inflation cylinder 110, a manual valve 112, a rope 114, spring hooks 116, a LED lights 118, a light reflective strip 120, a radar reflective pad 122, and an emergency radio beacon 124. Additionally, the inflatable platform 100 may also comprise of a pocket (not shown in the figures) configured on a portion of the floor layer 106 to carry an emergency thermal wrap, food, water, and other emergency supplies. The inflatable platform 100 is generally contained and stored within a carrying bag 200 (FIG. 2) in an uninflated state. The carrying bag 200 is designed to be on a person at all times so as to be easily accessible during an emergency requiring evacuation.

As illustrated in FIG. 1, the inflatable tubess 102 are structured and configured such that the inflatable platform 100 is formed in the shape of a hexagon with each concentric ring of inflatable tubess 102 arranged in the essential hexagonal framework. Other shapes are also contemplated to be within the disclosure of this invention, such as, but not limited to, triangular, rectangular, pentagonal, heptagonal, octagonal and so forth. Generally, one concentric ring of the inflatable tube 102 goes around the perimeter and defines the outer structure of the flotation platform. The inflatable platform 100 is designed to have a one-person capacity, and generally has a diameter in the range of 62 inches to 72 inches to accommodate at least the full length of a person when laying in a prone position. As seen on FIG. 1, each of the inflatable bars 104 is arranged between and the concentric inflatable tubes 102 and connects at a vertex on each inflatable tube 102. This arrangement along with the floor layer 106 integrated between the inflatable tube 102 and the inflatable bars 104 maintains and provides structural support to the inflatable platform 100.

In the disclosed non-limiting exemplary embodiment, the floor layer 106 is provided and configured as comprising part of the inflatable platform 100. FIG. 1 illustrates the floor layer 106 covering the area in between the inflatable tubes 102 and the inflatable bars 104.

Referring to FIG. 1, the personal flotation safety device is also comprised of a set of instructions 108 which are provided and configured on a portion of the inflatable platform 100. As shown in the figure, the instructions 108 are integrated on a section of the floor layer 106. The instructions 108 are provided for the safe deployment, operation, and all equipment on the inflatable platform 100. Alternatively, the instructions 108 may be permanently attached to a section of the inflatable tube 102 or the inflatable bar 104. Not shown in the figures, instructions may alternatively, or in addition to, be provided on the carrying bag 200 (FIG. 2) and the instructions will consist of the same material and properties as the instructions 108 integrated on the inflatable platform 100.

As seen in FIG. 1, inflatable platform 100 is also shown to comprise a $CO_2$ gas cylinder 110 connected to a valve (not shown). The inflatable platform 100 is also shown to comprise a manual valve 112 to allow for manual inflation of the inflatable tubing by mouth or a handpump (not shown) which may be included in the carrying bag 200. The manual valve 112 and the valve connected to the $CO_2$ gas cylinder 110 will be preferably adjoined to the outermost inflatable tube 102 by any means known in the art, which include means such as sealing with heat and pressure, cement glue, solvents, or a combination of the items. The $CO_2$ gas cylinder 110 will be stowed in the carrying bag 200 along with the inflatable platform 100 connected to the valve on the inflatable tube 102.

Figure 3:
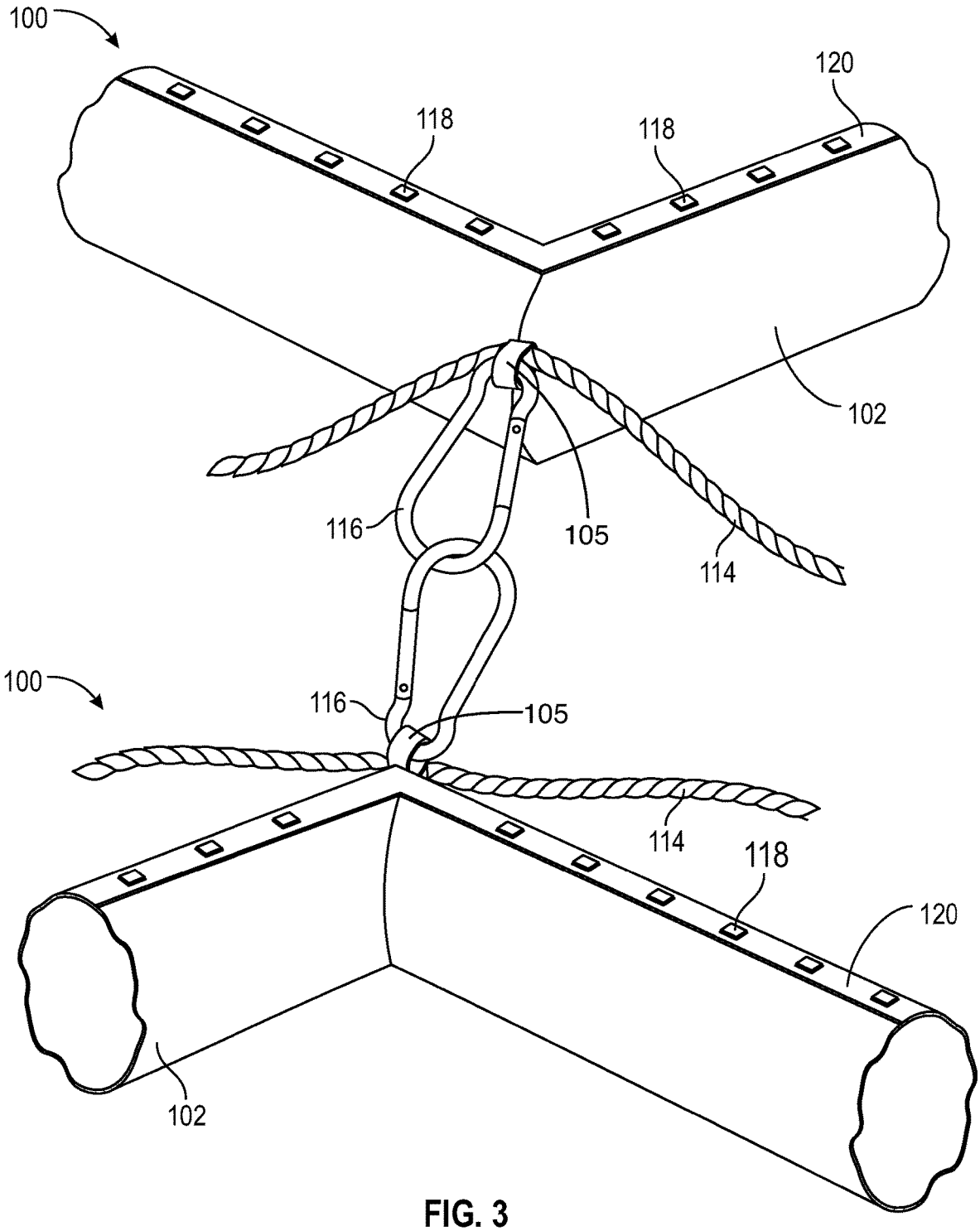
FIG. 3 is an illustration of a close-up view of a section of one inflatable platform connected to a second inflatable platform and each showing a light reflective strip, LED lights, a rope, and a carabiner.
Figure 6:
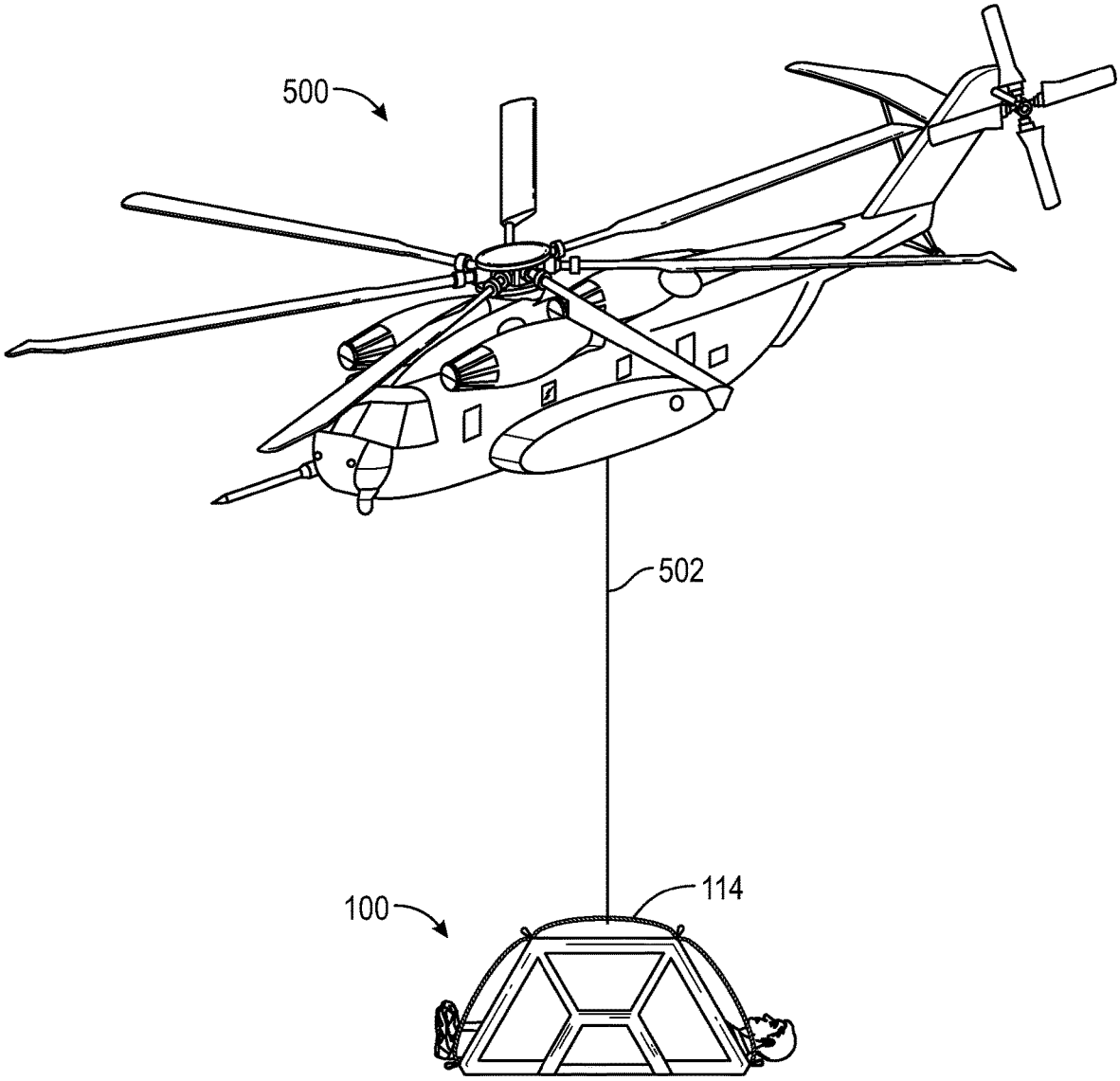
FIG. 6 is an illustration exhibiting a helicopter rescuing an individual on the inflatable platform with the aid of the ropes comprising part of the inflatable platform

In one or more non-limiting embodiments, the perimeter of the outermost inflatable tube 102 is coupled to a rope 114, as shown in FIG. 1 and FIG. 3. In one non-limiting embodiment, the rope 114 is assembled in sections such that two ends of the rope are adjoined at the vertices of the outermost inflatable tube 102 to form loops, which is dependent on the geometric structure of the inflatable platform 100. An alternative embodiment, as shown in FIG. 3, accommodates the rope though a fabric loop 105 integrated into the vertices of the outermost inflatable tube 102. The rope 114 may be fashioned of any material that is commonly used in the marine world especially for safely rescuing a person overboard, such as, but not limited to, polypropylene, nylon, or a combination. The rope 114 on the inflatable platform 100 provides for a way to lift an individual found on the inflatable platform during a sea rescue. FIG. 6 illustrates a rescue with a helicopter 500, where the helicopter 500 adapted for rescue at sea is equipped with a line 502, and the helicopter 500 has deployed the line 502 to lift the inflatable platform 100 by connecting to the ropes 114 on the inflatable platform 100. In this way, the inflatable platform 100 wraps and holds a person needing rescue securely while being lifted. Such lifting means are not described in currently available life rafts and other safety flotation devices.

Figure 7:
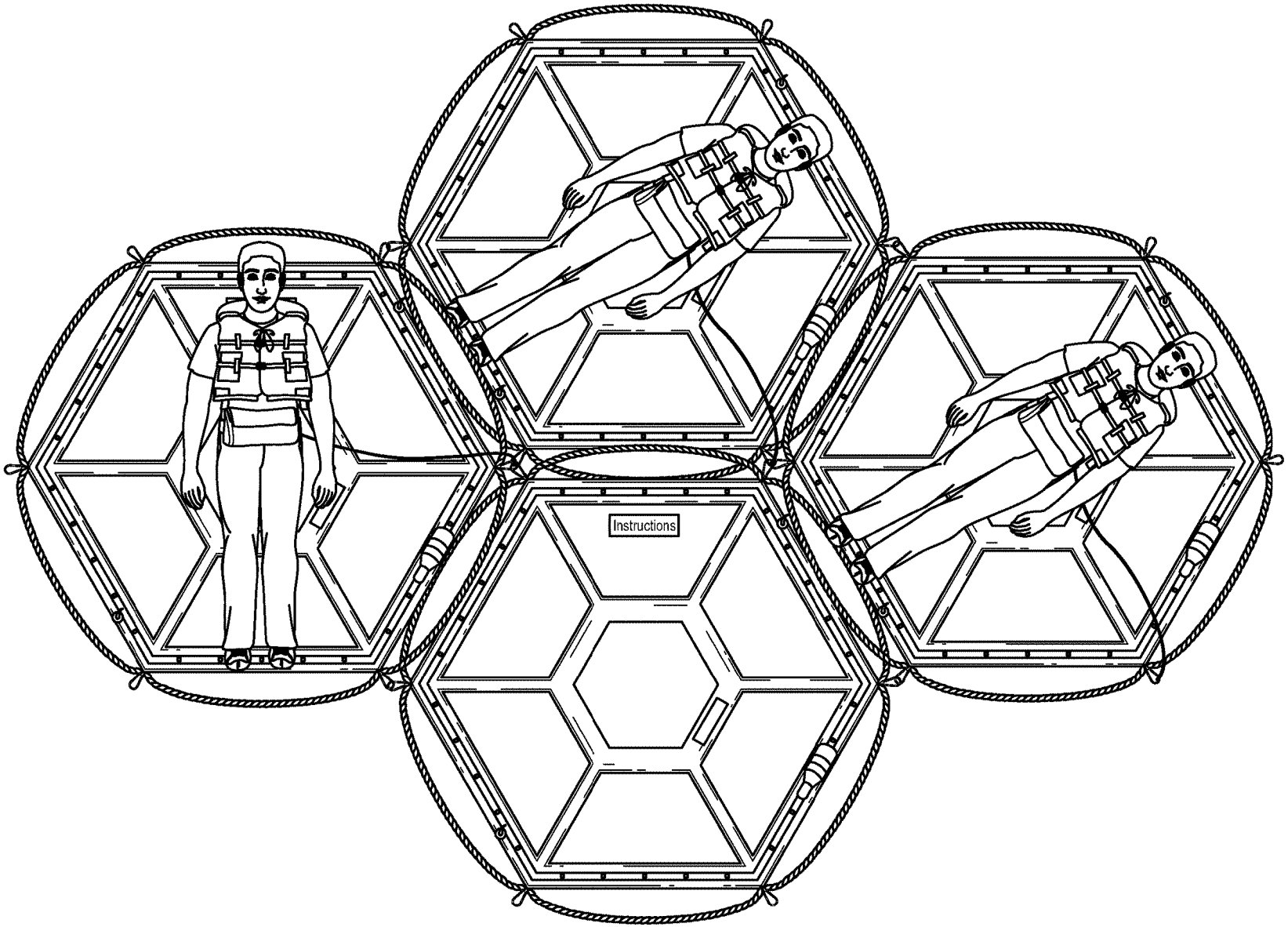
FIG. 7 is an illustration exhibiting the coupling of several inflatable platforms to each other.

In the non-limiting embodiments illustrated in FIG. 1 and FIG. 3, the inflatable platform 100 is also comprised of a multiplicity of spring hooks 116, such as and not limited to carabiners. As illustrated in FIG. 1, the spring hooks 116 are coupled to the vertices of the outermost inflatable tube 102. FIG. 3 further illustrates that the spring hooks 116 are connected to the vertices via the fabric loop 105 wherein each vertex on the outermost inflatable tube 102 has an integrated fabric loop 105. In other non-limiting embodiments, the spring hooks 116 may also be coupled to alternate sites on the outermost inflatable tube 102, such as on a straight arm portion. The spring hooks 116 allow joining of multiple inflatable platforms to each other, which provides several benefits. An individual in one inflatable platform 100 could line up two vertices of the outermost inflatable tube 102 to the vertices on another flotation platform and adjoin the two platforms by hooking the spring hooks on the two inflatable platforms to each other. FIG. 7 illustrates several inflatable platforms 100 adjoined to each other. As illustrated in FIG. 7, connecting the inflatable platforms 100 to each other achieves creating an overall larger platform, keeps all individuals who are overboard in close proximity of each other, creates a larger surface area which offers better visibility for rescuers, and also offers an intimidating structure to predatory marine animals. FIG. 7 also illustrates the advantage of the hexagonal shape of the inflatable platform 100, as this structure allows adjoining multiple flotation platforms without leaving a gap. Alternate attachment means are also contemplated within this disclosure, such as, but not limited to, a hook and loop attachment.

According to a non-limiting preferred embodiment, the inflatable platform 100 is also comprised of lights, illustrated in FIG. 1 and FIG. 3 as LED lights 118. The LED lights 118 may be placed anywhere on the inflatable platform; however, a preferred location is on the outermost inflatable tube 102. The LED lights 118 may be powered by any suitable battery located on the inflatable platform 100

(battery not shown in the figures). During an evacuation and deployment of the inflatable platform 100, an individual will generally lay or sit near the middle of the platform, leaving the outmost ring open and thus ensuring that rescuers can see the light from the LEDs 118. FIG. 1 and FIG. 3 illustrates that the LED lights 118 are in the form of a strip which are placed and secured by any suitable means on the outermost inflatable tube 102. The strip, in the preferred embodiment, is a light reflective strip 120 to facilitate rescue. In addition, FIG. 1 also illustrates the radar reflective pad 122 that is also secured to the inflatable platform 100 on the inflatable tube 102.

The inflatable platform 100 of the personal flotation device is also comprised of a suitable emergency radio beacon which communicates via a satellite system. The satellite system can be activated to transmit that a flotation platform has been launched and that rescue is warranted. FIG. 1 illustrates an example of a suitable radio beacon, wherein an emergency position indicating radio beacon (EPIRB) 124 is supported and equipped to the inflatable platform 100. A cord 126 preferably connects the EPIRB 126 to the spring hook 116 on the outermost inflatable tube 102. The transponder and satellite system may employ any suitable battery. The signal can be initiated when the EPIRB 124 enters the water. Manual means of initiating a distress signal are also contemplated and within the disclosure of this invention, such as a switch on the beacons.

Figure 2:
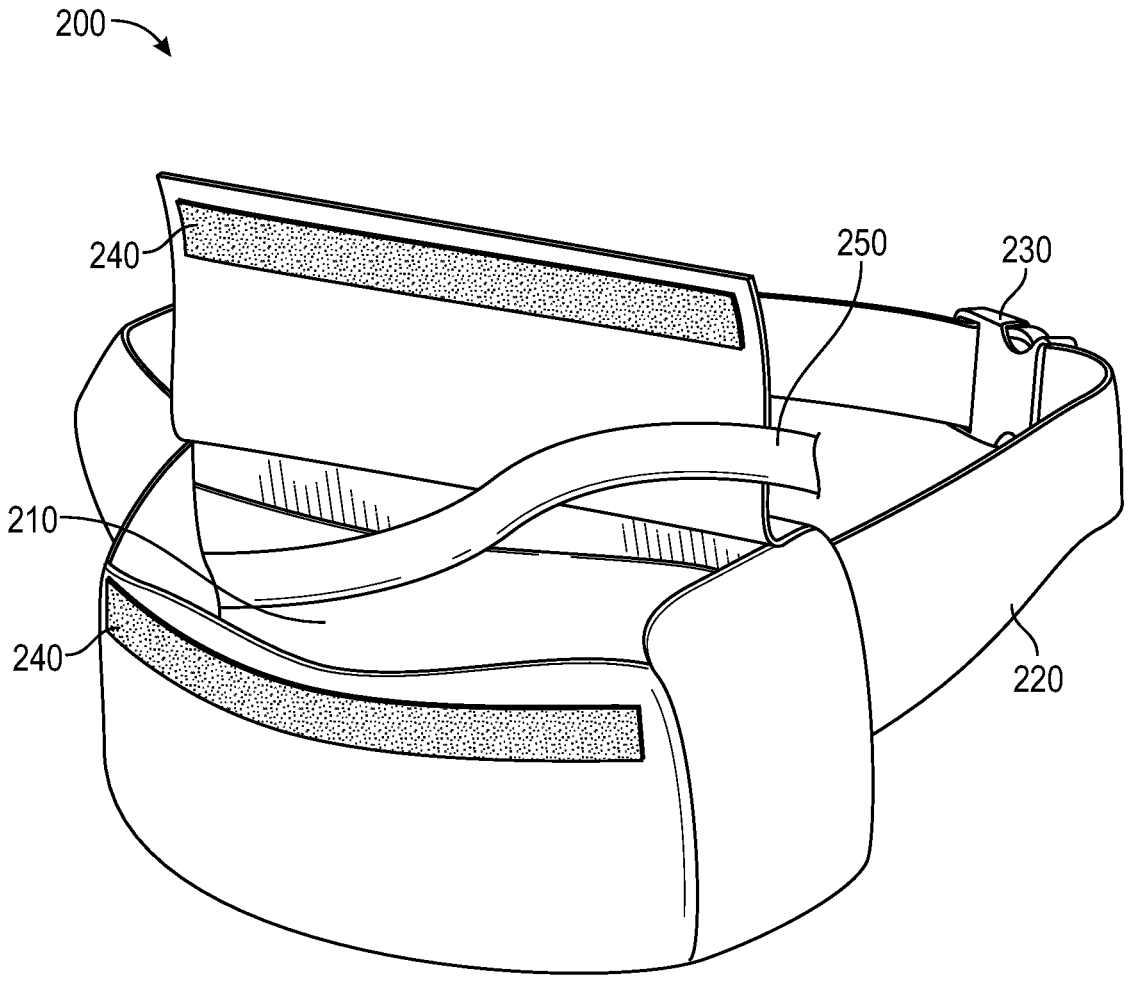
FIG. 2 is an illustration of an example of a carrying bag of the personal flotation safety device.
Figure 4:
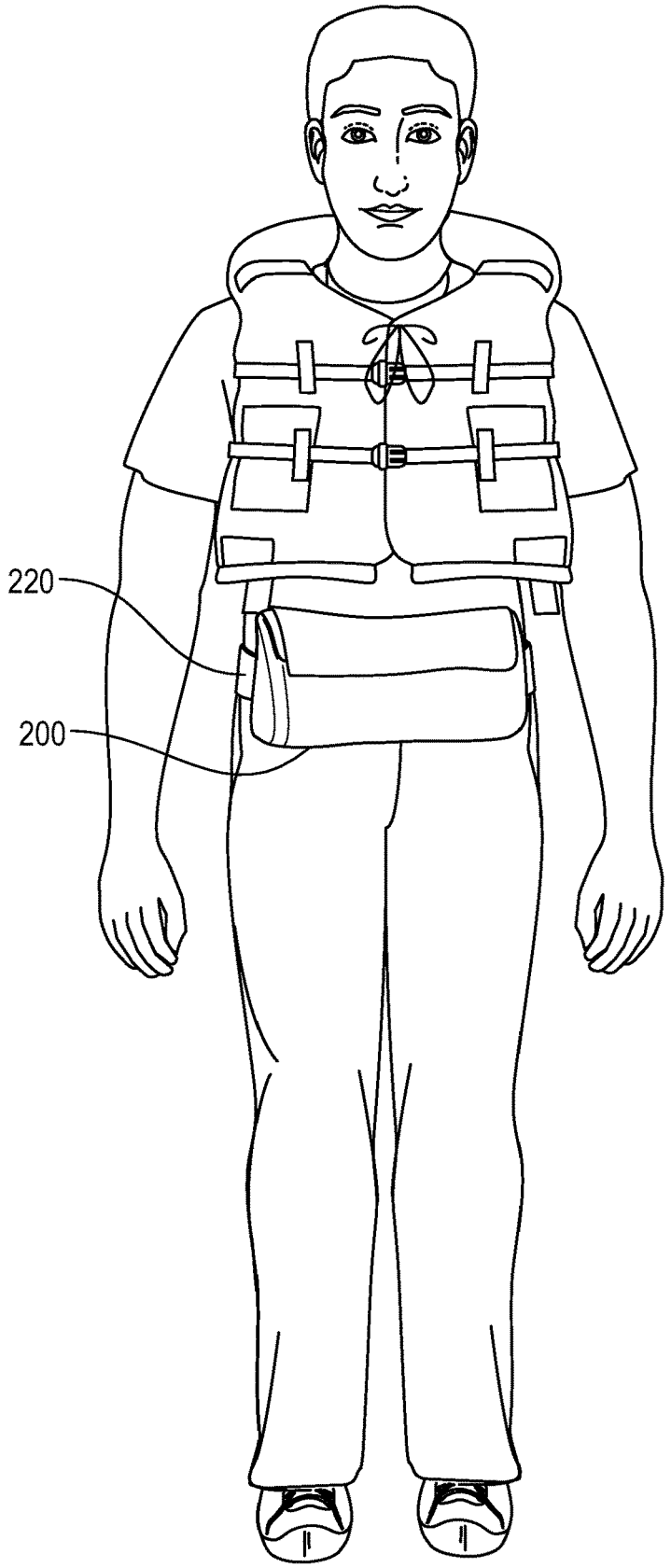
FIG. 4 is an illustration of a person wearing the example of a carrying bag.
Figure 5:
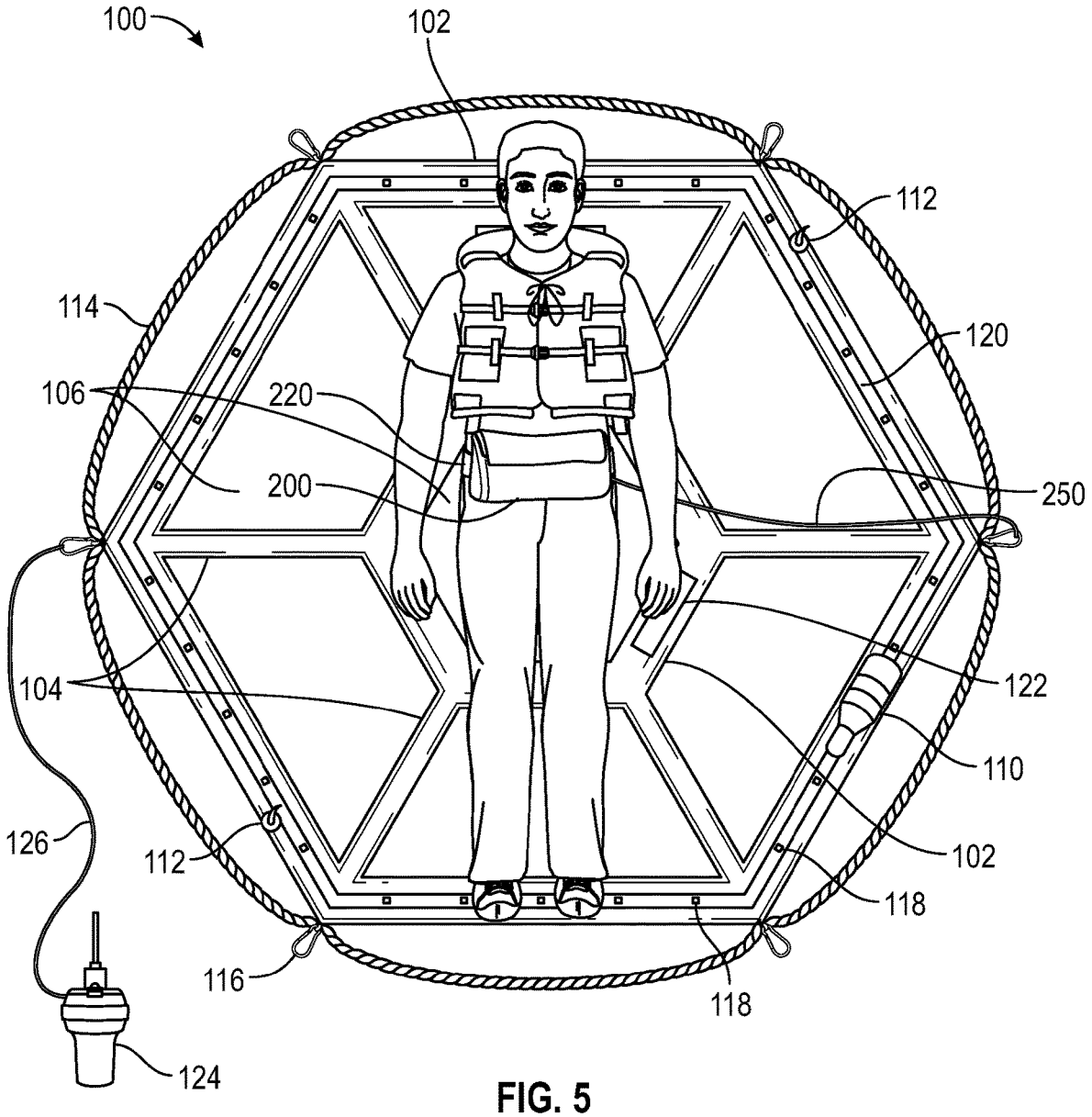
FIG. 5 is an illustration of a person aboard the inflatable platform.

FIG. 2 illustrates an example of the carrying bag 200, which also comprises part of the personal flotation safety device. The inflatable platform 100, in a deflated state, is compactly fit and carried in the carrying bag 200. In the non-limiting example illustrated in FIG. 2, carrying bag 200 comprises of an opening 210, a belt 220, a pair of clips 230, an enclosure means 240, an attachment strap 250, a pocket (not shown), and instructions (not shown). As shown in FIG. 4, the carrying bag 200 can be carried on a person at all times and thus can be wrapped around an individual's waste with the belt 220 and clips 230. The inflatable platform 100 is connected to carrying bag 200 by the attachment strap 250, wherein a first end of the connection is preferably sewn on an inside portion of the carrying bag 200 and a second end of the attachment strap 250 is connected to the inflatable platform at any of the spring hooks 116 (as seen in FIG. 5) or any other suitable location on the inflatable platform 100. Alternate embodiments may include other means of attaching the bag to a person, such as, but not limited to, spring hooks. The opening 210 in the carrying bag is closed by the enclosure means 240, which preferably comprises of VELCRO. The advantage of having VELCRO for the enclosure means 240 is that once a person is overboard, contact with the water will initiate automatic inflation of the inflatable tubes via the compressed $CO_2$ gas cylinder. The inflatable tube upon inflation can push against the opening 210 in the carrying bag 200 and extend out to continue inflating on the water. The attachment strap 250 ensures that the inflatable platform 100 remains attached to the carrying bag and hence to a person wearing the carrying bag 200.

When the carrying bag 200 with the inflatable platform 100 is on the person, the personal flotation safety device is readily available for use in case of an emergency necessitating an evacuation.

Accordingly, the present description provides one or more embodiments for a useful and much needed personal flotation safety device. One advantage of the personal flotation safety device, as described herein in one or more embodiments, is that an individual at sea may have the device on the person at all times so that the device is readily available in case of an emergency that necessitates an evacuation from the ship. The exemplary geometric configuration of the inflatable platform also allows multiple flotation platforms to be adjoined to each other so that all evacuees can be near each other. Additionally, adjoining the inflatable platforms also provides the advantage of better visibility for rescuers by creating a bigger surface and thus creating a larger surface area. The exemplary inflatable platform has an emergency radio beacon enjoined with a satellite system to provide a distress signal to rescuers. In addition, the exemplary inflatable platform has the advantage of providing a means for a rescue helicopter to securely lift the inflatable platform using ropes coupled to the outermost inflatable tube and having the individual securely nestled within the inflatable platform. Thus, the personal flotation safety device, as described in one or more non-limiting embodiments throughout this document, offers an improved device for keeping crew and sea faring people of a sunk, capsized, burned, or otherwise uninhabitable boat safe and alive until they can be rescued.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What may be claimed is:

1. A personal flotation safety device, comprising:

an inflatable platform having a plurality of inflatable tubes, a plurality of inflatable bars, and a floor layer, wherein each of the inflatable tubes of the plurality of inflatable tubes are arranged concentrically, wherein each of the inflatable bars of the plurality of inflatable bars is arranged between and connecting each of the inflatable tubes of the plurality of inflatable tubes, and the floor layer is integrated between the plurality of inflatable tubes and the plurality of inflatable bars wherein the inflatable platform further comprising:

an instruction label configured to be enjoined on a surface of either one of the inflatable tubes of the plurality of inflatable tubes or the floor layer;

a self-inflatable gas canister connected to a valve integrated on the surface of one of the inflatable tubes of the plurality of inflatable tubes;

a manual inflation valve integrated on the surface of one of the inflatable tubes of the plurality of inflatable tubes;

one or more LED lights integrated on one or more inflatable tubes of the plurality of inflatable tubes;

one or more radar reflective pads integrated on one or more inflatable tubes of the plurality of inflatable tubes;

one or more light reflective strips integrated on one or more inflatable tubes of the plurality of inflatable tubes; and a carrying bag attachable to a person, wherein the inflatable platform is contained within the carrying bag.

2. The personal flotation device of claim 1, wherein the plurality of inflatable tubes and the plurality of inflatable bars are inflatable and the connection between each of the inflatable tubes of the plurality of inflatable tubes and each of the inflatable bars of the plurality of inflatable bars is such that air within is communicating between the plurality of inflatable tubes and the plurality of inflatable bars.

3. The personal flotation safety device of claim 1, further comprising a rope attached to an outermost inflatable tubes of the plurality of inflatable tubes, wherein the rope is connected to one or more vertices of the outermost inflatable tubes of the plurality of inflatable tubes.

4. The personal flotation safety device of claim 1, further comprising a plurality of spring hooks configured to be connected to the one or more vertices of the outermost inflatable tubes of the plurality of inflatable tubes such as to be easily accessible to be connected to a spring hook of a plurality of spring hooks of a second personal safety flotation device.

5. The personal flotation safety device of claim 1, wherein the carrying bag has a strap with a clip to secure the carrying bag around an individual's waist.

6. The personal flotation safety device of claim 1, wherein an emergency radio beacon is attached to the inflatable platform with an attachment cord.

7. The personal flotation safety device of claim 1, the carrying bag being connected to the inflatable platform by a connection strap, wherein a first end of the connection strap is connected to an interior portion of the carrying bag and a second end of the connection strap is connected to one of the spring hooks of the plurality of spring hooks on the inflatable platform.

8. The personal flotation safety device of claim 1, wherein the carrying bag has an enclosure capable of allowing the inflatable platform stored within the carrying bag to expand and push open the enclosure while inflating such that the inflatable platform passes through the enclosure and inflates fully outside the carrying bag.

9. The personal flotation safety device of claim 1, wherein a pocket to store an emergency thermal wrap, a whistle, a hand pump, food items, and water is configured on the carrying bag, the inflatable platform, or on both the carrying bag and the inflatable platform.

10. The personal flotation safety device of claim 1, wherein the inflatable platform has a diameter in the range of 62 inches to 72 inches.

11. The personal safety flotation device of claim 1, wherein the inflatable platform is configured in a hexagonal shape, wherein each of the inflatable tubes of the plurality of inflatable tubes is configured in the hexagonal shape and the inflatable platform has a web like appearance.

12. A personal flotation safety device, comprising:

an inflatable platform having a plurality of inflatable tubes, a plurality of inflatable bars, and a floor layer, wherein each of the inflatable tubes of the plurality of inflatable tubes is configured in a hexagonal shape, the plurality of inflatable tubes arranged concentrically and having the plurality of inflatable bars arranged between and connecting the plurality of inflatable tubes with air communicating between the plurality of inflatable tubes and the plurality of inflatable bars, and the floor layer integrated between the plurality of inflatable tubes and the plurality of inflatable bars, wherein the inflatable platform has a web like appearance and further comprising:

an instruction label configured to be enjoined on a surface of either one of the inflatable tubes of the plurality of inflatable tubes or the floor layer;

a self-inflatable gas canister connected to a valve integrated on the surface of one of the inflatable tubes of the plurality of inflatable tubes;

a manual inflation valve integrated on the surface of one of the inflatable tubes of the plurality of inflatable tubes;

one or more LED lights integrated on one or more of the inflatable tubes of the plurality of inflatable tubes;

one or more radar reflective pads integrated on one or more of the inflatable tubes of the plurality of inflatable tubes;

one or more light reflective strips integrated on one or more of the inflatable tubes of the plurality of inflatable tubes; and a carrying bag attachable to a person, wherein the inflatable platform is contained within the carrying bag.

13. The personal flotation safety device of claim 12, further comprising a rope attached to an outermost inflatable tube of the plurality of inflatable tubes, wherein the rope is connected to one or more vertices of the outermost inflatable tube of the plurality of inflatable tubes.

14. The personal flotation safety device of claim 12, further comprising a plurality of spring hooks configured to be connected to one or more vertices of an outermost inflatable tube of the plurality of inflatable tubes such as to be easily accessible to be connected to a spring hook of a second personal safety flotation device.

15. The personal flotation safety device of claim 12, wherein the carrying bag has a strap with a clip to secure the carrying bag around an individual's waist.

16. The personal flotation safety device of claim 14, wherein an emergency radio beacon is attached to the inflatable platform with an attachment cord, wherein a first end of the attachment cord is connected to a spring hook of the plurality of spring hooks on the inflatable platform and a second end is connected to the emergency radio beacon.

17. The personal flotation safety device of claim 14 the carrying bag being connected to the inflatable platform by a connection strap, wherein a first end of the connection strap is connected to an interior portion of the carrying bag and a second end of the connection strap is connected to one spring hook of the plurality of spring hooks on the inflatable platform.

18. The personal flotation safety device of claim 12, wherein the carrying bag has an enclosure capable of allowing the inflatable platform stored within the carrying bag to expand and push open the enclosure while inflating such that the inflatable platform passes through the enclosure and inflates fully outside the carrying bag.

19. The personal flotation safety device of claim 12, wherein a pocket to store an emergency thermal wrap, a whistle, a hand pump, food items, and water is configured on the carrying bag, the inflatable platform, or on both the carrying bag and the inflatable platform.

20. The personal flotation safety device of claim 12, wherein the inflatable platform has a diameter in the range of 62 inches to 72 inches.

* * * * *